US008439128B2

(12) United States Patent
Vatne

(10) Patent No.: US 8,439,128 B2
(45) Date of Patent: May 14, 2013

(54) DEVICE FOR CLEANING AND DOPING EQUIPMENT FOR THREADS

(75) Inventor: Per A. Vatne, Kristiansand (NO)

(73) Assignee: Wellquip AS, Kristiansand (NO)

( * ) Notice: Subject to any disclaimer, the term of this patent is extended or adjusted under 35 U.S.C. 154(b) by 524 days.

(21) Appl. No.: 12/088,452

(22) PCT Filed: Sep. 27, 2006

(86) PCT No.: PCT/NO2006/000332
§ 371 (c)(1),
(2), (4) Date: May 1, 2008

(87) PCT Pub. No.: WO2007/037698
PCT Pub. Date: Apr. 5, 2007

(65) Prior Publication Data

US 2008/0223418 A1 Sep. 18, 2008

(30) Foreign Application Priority Data

Sep. 30, 2005 (NO) ..... 20054518

(51) Int. Cl.
*E21B 44/00* (2006.01)

(52) U.S. Cl.
USPC ..... 175/24; 134/99.1

(58) Field of Classification Search ..... None
See application file for complete search history.

(56) References Cited

U.S. PATENT DOCUMENTS

| | | | | |
|---|---|---|---|---|
| 4,199,858 | A * | 4/1980 | Meijs | 29/458 |
| 4,515,045 | A | 5/1985 | Gnatchenko et al. | |
| 4,762,187 | A * | 8/1988 | Haney | 175/171 |
| 6,550,547 | B1 * | 4/2003 | Payne et al. | 175/24 |
| 6,829,968 | B2 * | 12/2004 | Hauk et al. | 81/57.16 |
| 2004/0049905 | A1 | 3/2004 | Jansch et al. | |

FOREIGN PATENT DOCUMENTS

| | | | |
|---|---|---|---|
| WO | WO 01/49968 | A1 | 7/2001 |
| WO | WO 2004/025071 | A1 | 3/2004 |

OTHER PUBLICATIONS

PCT Office, "Written Opinion of the International Searching Authority," (Dec. 21, 2006).

* cited by examiner

*Primary Examiner* — Michael Barr
*Assistant Examiner* — Jason Ko
(74) *Attorney, Agent, or Firm* — Eubanks PLLC

(57) ABSTRACT

A device for cleaning and doping (lubrication) equipment for threads (3*b*, 4*b*) of the type used to join pipes (4) to a pipe string (3), especially in connection with petroleum production, where cleaning fluid and dope (lubricant) are sprayed at the threads (3*b*, 4*b*) at relatively high pressure from at least one nozzle (5, 6) mounted in the rotatable make-up section (1) of a power tong, and where at least one injection pump (7, 8) arranged to supply cleaning fluid or dope to the at least one nozzle (5, 6) is located in the rotatable make-up section (1).

12 Claims, 2 Drawing Sheets

DEVICE FOR CLEANING AND DOPING EQUIPMENT FOR THREADS

CROSS-REFERENCE TO PENDING APPLICATIONS

Figure 1:
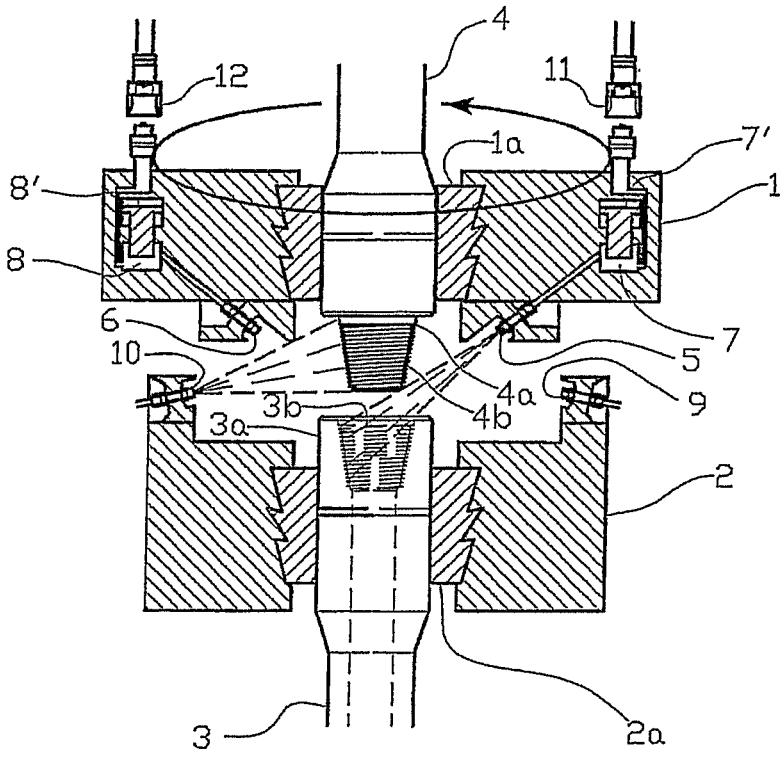

This application is based on PCT Patent Application No. NO2006/000332, filed on Sep. 27, 2006, which was based on Norwegian Patent Application No. 20054518, file on Sep. 30, 2005.

This invention regards cleaning and doping equipment for threads. More particularly, it regards cleaning and doping equipment for threads of the type used to join pipes to a pipe string, particularly in connection with petroleum production, and where cleaning fluid and dopes are sprayed at the thread at a relatively high pressure, with at least one nozzle and one injection pump being arranged in a power tong.

When joining threaded drill pipes, the threads are typically doped. Besides facilitating the coupling and uncoupling of pipes, the purpose of applying dope is to seal the threaded connection between the box and the pin when this is subjected to the relatively high fluid pressures that occur during drilling. Advantageously the corresponding threaded portions are cleaned by means of e.g. a cleaning fluid prior to the application of dope (lubricant). Advantageously any residual cleaning fluid is removed from the threaded portions after cleaning.

Advantageously the cleaning and doping take place as a pipe is screwed onto the pipe string, and so obviously the cleaning fluid and dope are supplied via nozzles mounted in close proximity to the pipe string, and particularly on or by the gripping jaws of the so-called power tong.

When joining the pipes, an internally (female) threaded box portion at the upper end portion of the pipe string projects up through the lower section of the power tong, the so-called reaction section. The pipe string is held still during the joining.

The lower portion of the pipe to be joined to the pipe string is brought down into the upper section of the power tong, the so-called make-up section, and is clamped immediately above the upper portion of the pipe string with a male thread pin facing the box of the pipe string.

For joining, the pipe is rotated by rotating the make-up section. During this rotation fixed nozzles in close proximity to and below the make-up section will provide a sufficient and continuous supply of cleaning fluid and dope to the male pin threads of the pipe.

For cleaning and doping (lubrication) of the female box threads of the stationary pipe string it is preferable to have a nozzle that moves around the central axis of the pipe string, e.g. by a set of nozzles being mounted on the rotatable make-up section. The obvious arrangement is to supply cleaning fluid and dope from stationary reservoirs externally of the power tong, via a swivel device that is known per se, to the nozzles on the rotatable make-up section. Sealing means prevent leakage of fluid between rotary and stationary swivel components, which is a demanding task, particularly in the case of the cleaning fluid, which is conveyed at a high pressure.

The object of the invention is to remedy or reduce at least one of the drawbacks of prior art.

The object is achieved in accordance with the invention, through the features specified in the description below and in the following claims.

The invention regards a device for cleaning and doping equipment for threads of the type used to join pipes to a pipe string, particularly in connection with petroleum production, where cleaning fluid and dope are sprayed at the threads at a relatively high pressure, from at least one nozzle mounted at least in the rotatable make-up section of a power tong, at least one injection pump arranged to supply cleaning fluid or dope to the at least one nozzle being located in the rotatable make-up section.

Preferably a supply line to the at least one injection pump is arranged to be connected for fluid communication with a reservoir for cleaning fluid or dope when the make-up section of the power tong assumes an inactive idle position.

Advantageously the cleaning fluid and dope reservoirs are pressurized.

Preferably the driving device of the at least one injection pump is in fluid communication with a hydraulic pressure system that is integrated into the rotatable make-up section, and which has no connection to the non-rotatable sections of the power tong.

Preferably the fluid communication between the driving device of the at least one injection pump and the hydraulic pressure system of the rotatable make-up section is sequential and controlled by the movement of the power tong, by one or more actuators or a combination of these.

Advantageously the rotatable make-up section of the power tong is provided with at least one compressed-air nozzle in fluid communication with a compressed-air accumulator located in the rotatable make-up section.

Preferably the fluid communication between the at least one compressed-air nozzle of the rotatable make-up section of the power tong and the compressed-air accumulator is sequential and controlled by the cleaning fluid injection pump.

Advantageously a supply line to the compressed-air accumulator is arranged to be connected for fluid communication with a source of compressed-air when the make-up section of the power tong assumes an inactive idle position.

Figure 2:
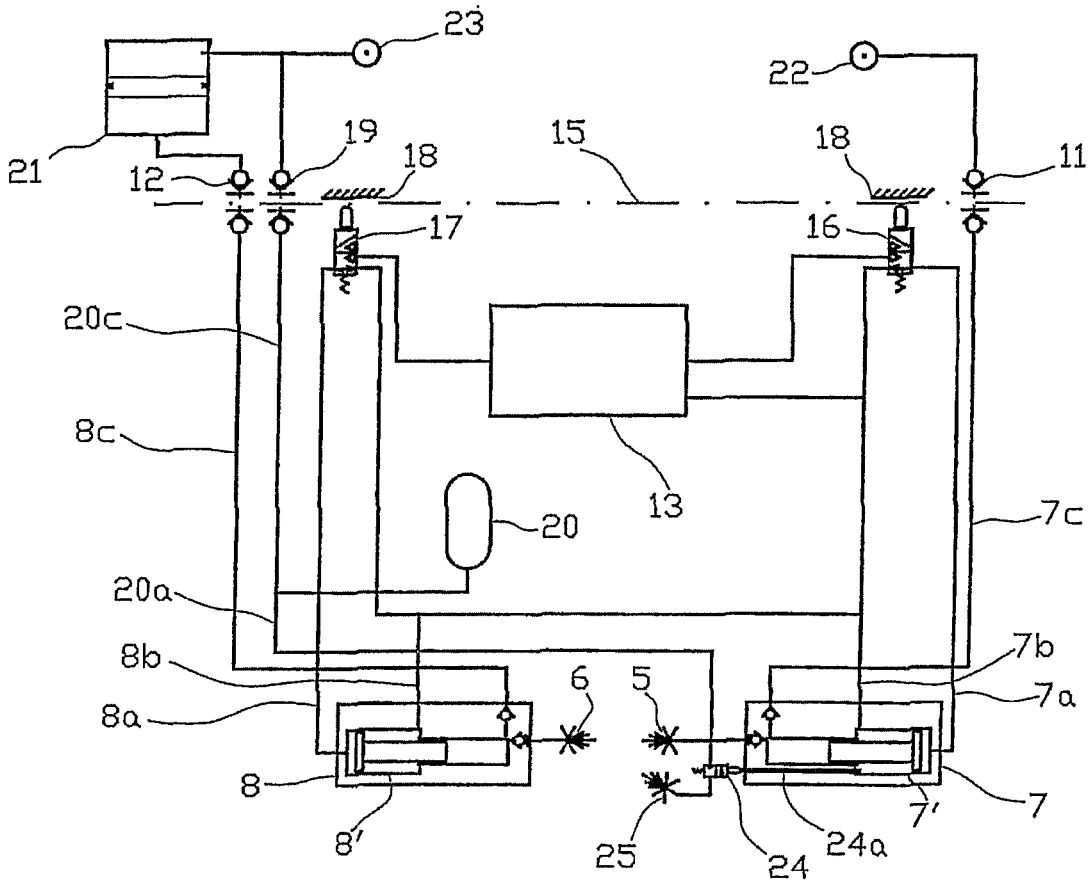

The following describes a non-limiting example of a preferred embodiment illustrated in the accompanying drawings, in which:

FIG. 1 is a partially sectioned side view of a nozzle and pump arrangement in a power tong according to the invention; and FIG. 2 is a schematic diagram showing a general arrangement according to the invention, schematically showing nozzles, pumps, driving means, and fluid accumulators, reservoirs and sources, as well as valves.

In the drawings, reference number 1 denotes the rotatable make-up section of a power tong, while the reaction section of the power tong is denoted by reference number 2.

An upper box shaped end portion 3*a* of a pipe string 3 is clamped by the gripping jaws 2*a* of the reaction section 2, in a manner that is known per se. The box portion 3*a* has female threads 3*b*.

A pin shaped lower end portion 4*a* of a pipe 4 is clamped by gripping jaws 1*a* of the make-up section 1, in a manner that is known per se. The pin portion 4*a* has male threads 4*b* that correspond with the threads 3*b* of the box portion 3*a*.

The rotatable make-up section 1 is provided with a first nozzle 5 for distribution of a cleaning fluid, and which is connected with the delivery side of a first injection pump 7 in a fluid communicating manner. Similarly, a second nozzle 6 for distribution of a dope is connected with the delivery side of a second injection pump 8 in a fluid communicating manner. The nozzles 5, 6 are directed at the female threads 3*b* of the upper portion of the non-rotating pipe string 3.

The pressure sides of the driving means 7', 8' for the injection pumps 7, 8 are connected for fluid communication with a hydraulic system 13, via pressure lines 7*a* and 8*a*, respectively. Suitable for this purpose would be a hydraulic system in which hydraulic pressure is provided through the closing movement of the make-up section in order to grip the pipe. The pressure lines 7*a*, 8*a* are passed via directional valves 16 and 17, respectively, which may be actuated by a vertical movement of the make-up section 1 or a combination of the vertical movements of the actuator 18 and the make-up section 1 bringing an annular actuator 18 located above and parallel to the make-up section 1 into contact with the directional valve 16, 17 and actuating this. The return sides of the driving means of the cleaning fluid and dope pumps 7, 8 are connected for fluid communication with the pressure side of the driving means via return lines 7*b* and 8*b*, respectively, pressure lines 7*a* and 8*a*, respectively, and directional valves 16 and 17, respectively, when the directional valves 16, 17 are not actuated by the actuator 18 or the make-up section 1 or by a combination of the vertical movement of the actuator 18 and the make-up section 1.

The make-up section 1 is also provided with a compressed-air accumulator 20 connected in fluid communication with a compressed-air nozzle via compressed-air lines 20*a* and a directional valve 24. The directional valve 24 is connected to the cleaning fluid pump 7 via a actuator 24*a*, so that when the driving means of the cleaning fluid pump 7 reaches a predetermined stage in the pump drive cycle, e.g. when it reaches the limit of linear travel of the pump stroke, the directional valve 24 is opened to allow compressed air to pass from the accumulator 20 out through the compressed-air nozzle 25. The volume of the accumulator 20 is sufficient to supply the compressed-air nozzle 25 with enough compressed air to remove residual cleaning fluid. The compressed-air nozzle 25 is directed at the female threads 3*b* of the upper portion of the non-rotating pipe string 3.

When the make-up section 1 is stationary and open, the cleaning fluid pump 7, the dope pump 8 and the accumulator 20 are in fluid communication with a pressurised source 22 of cleaning fluid, a dope reservoir 21 and a compressed-air source 23, respectively, via lines 7*c*, 8*c* and 20*c*, respectively, and quick release couplings 11, 12 and 19, respectively, located at the interface 15 between the moving make-up section and a surrounding static power tong structure. Through this sequential fluid communication connection the pumps 7, 8 and the accumulator 20 are filled with a quantity of cleaning fluid, dope and compressed air, respectively. When the make-up section 1 of the power tong is moved to grip a pipe 4, the connections between the pumps 7, 8 and the accumulator 20, respectively, and the cleaning fluid source 22, the dope reservoir 21 and the compressed-air source 23, respectively, are disconnected by the quick release couplings 11, 12 and 19 being activated in a manner that is known per se.

The stationary reaction section 2 is provided with a cleaning fluid nozzle 9, a dope nozzle 10 and a compressed-air nozzle (not shown) in permanent fluid communication with the pressurized source 22 of cleaning fluid, the dope reservoir 21 and the compressed-air source 23, respectively, via control valves (not shown). The nozzles of the reaction section 2 are directed at the male threads 4*b* of the rotatable pipe 4.

Cleaning fluid and dope are typically supplied to the nozzles 5, 6 at a pressure of the order of 50-60 mPa.

The supply of cleaning fluid, compressed air and dope directed at the threaded portions 3*b*, 4*b* is sequentially controlled, with the following sequence:

1. The rotation of the make-up section 1 is stopped;
2. The make-up section 1 is opened, the hydraulic system 13 builds up pressure and the quick release couplings 11, 12 and 19 connect the make-up section 1 to the dope reservoir 21, the cleaning fluid source 22 and the compressed-air source 23;
3. A pipe 4 is gripped, rotated and lowered towards the upper portion of the pipe string 3;

4a. The injection pumps 7 and 8 are actuated sequentially, through remote control of the hydraulic system 13, to deliver, in sequence, cleaning fluid, compressed air and dope at the threaded portion 3*b* of the non-rotating pipe string 3, through nozzles 5, 25 and 6;

4b. Simultaneously, cleaning fluid, compressed air and dope is delivered sequentially at the threaded portion 4*b* of the rotating pipe 4, through the respective stationary nozzles of the reaction section.

5. The pipe 4 is joined to the pipe string 3 by continued rotation of the make-up section 1 and lowering of the pipe 4 until a prescribed torque has been achieved.

The present invention eliminates the need to transfer fluid via one or more swivel structures, thus simplifying the maintenance of the power tong, increasing the reliability and improving the quality of the screwed connections in the pipe string.

The invention claimed is:

1. A device for cleaning and doping threads of pipe held in a power tong having a reactive section and a rotatable make-up section, said device comprising:

a power tong having a reactive section and a rotatable make-up section with a rotatable element, at least one nozzle mounted on the rotatable element of the rotatable make-up section of the power tong, at least one injection pump located on the rotatable element of the rotatable make-up section and arranged to supply fluid to the at least one nozzle.

2. A device in accordance with claim 1, further comprising a supply line to a first of the at least one injection pump and a cleaning fluid source, said supply line connectable for fluid communication with the cleaning fluid source when the rotatable element of the rotatable make-up section assumes an inactive idle position.

3. A device in accordance with claim 2, further comprising said cleaning fluid source being pressurized.

4. A device in accordance with claim 1, further comprising a stationary dope reservoir and a supply line to a second of the at least one injection pump, said second injection pump mounted on the rotatable element of the rotatable make-up section of the power tong and said supply line connectable for fluid communication with the stationary dope reservoir when the rotatable element of the rotatable make-up section of the power tong assumes an inactive idle position.

5. A device in accordance with claim 4, further comprising said dope reservoir being pressurized.

6. A device in accordance with claim 1, further comprising a driving means of the at least one injection pump, said drive means in fluid communication with a hydraulic pressure system integrated into the rotatable element of the rotatable make-up section, and which is not in fluid communication with a non-rotatable structure of the power tong.

7. A device in accordance with claim 6, further comprising the fluid communication between the driving means of the at least one injection pump and the hydraulic pressure system of the rotatable make-up section is controlled by the movement of the rotatable element of the make-up section.

8. A device in accordance with claim 6, further comprising the fluid communication between the driving means of the at least one injection pump and the hydraulic pressure system of the rotatable make-up section is controlled by at least one actuator.

9. A device in accordance with claim 6, further comprising the fluid communication between the driving means of the at least one injection pump and the hydraulic pressure system of the rotatable make-up section is sequential.

10. A device in accordance with claim 1, further comprising at least one compressed air nozzle mounted in the rotatable element of the rotatable make-up section of the power tong, said at least one compressed-air nozzle in fluid communication with a compressed-air accumulator provided in the rotatable element of the rotatable make-up section.

11. A device in accordance with claim 10, further comprising the fluid communication between the at least one compressed-air nozzle of the rotatable make-up section of the power tong and the compressed-air accumulator is sequential and controlled by the cleaning fluid injection pump.

12. A device in accordance with claim 11, further comprising a supply line to the compressed-air accumulator arranged to be connected for fluid communication with a compressed-air source when the make-up section of the power tong assumes an inactive idle position.

* * * * *